United States Patent [19]

Weins

[11] Patent Number: 4,870,837

[45] Date of Patent: Oct. 3, 1989

[54] DEVICE FOR MAINTAINING THE CHILL ON A BOTTLE OF WINE

[76] Inventor: Janine J. Weins, 6 Allen St., Lebanon, N.H. 03766

[21] Appl. No.: 132,612

[22] Filed: Dec. 9, 1987

Related U.S. Application Data

[63] Continuation of Ser. No. 908,658, Sep. 18, 1986, abandoned.

[51] Int. Cl.[4] ..... F25D 3/08

[52] U.S. Cl. ..... 62/457.4; 62/372; 62/457.8; 62/530; 215/100.5; 215/13.1; 220/903

[58] Field of Search ..... 62/457, 371, 372, 529, 62/530, 457.4, 457.8; 220/903; 215/12 R, 12 A, 13 A, 13 R, 100.5

[56] References Cited

U.S. PATENT DOCUMENTS

| | | | |
|---|---|---|---|
| 2,917,906 | 12/1959 | Woolley | 62/457 X |
| 3,365,911 | 1/1968 | Stoner et al. | 62/457 |
| 3,434,302 | 3/1969 | Stoner et al. | 62/530 X |
| 3,743,130 | 7/1973 | Jorgensen | 62/372 |
| 3,807,194 | 4/1974 | Bond | 62/457 |
| 3,995,445 | 12/1976 | Huskins | 62/371 |
| 4,281,520 | 8/1981 | Norwood | 62/372 |
| 4,299,100 | 11/1981 | Crisman et al. | 62/457 |
| 4,324,111 | 4/1982 | Edwards | 62/457 |
| 4,531,381 | 7/1985 | Toro et al. | 62/372 |
| 4,549,410 | 10/1985 | Russell | 62/457 |

*Primary Examiner*—Lloyd L. King

*Attorney, Agent, or Firm*—Janine J. Weins; Michael J. Weins

[57] ABSTRACT

The present invention is directed to a vessel having a high heat capacity sidewall for use in maintaining the chill on a container such as a bottle of wine. The base of the vessel may be provided with an insulating layer to limit heat conductivity between the vessel and a surface on which the vessel may be placed. In a preferred embodiment of the present invention the vessel is provided with a closure means. In another preferred embodiment the vessel is provided with an absorbent layer so that when the container is removed from the vessel it will be wiped of condensed moisture. In yet another embodiment of the present invention, the vessel is provided with high heat capacity fins to increase the thermal conductivity between a container placed within the vessel and the vessel sidewall. The fins may further serve to constrict the movement of a container placed within the vessel. In a preferred embodiment the sidewall of the vessel contains a fluid having a melting point near the temperature at which it is desired to maintain the container which may be placed within the vessel. If the container is used to store white wine, the sidewall of the vessel may be filled with a fluid having melting point of about 0° C. to 7° C. If the vessel is used to store red wine the sidewall may be filled with a fluid having a melting point of between about 15° C. and 22° C. The present invention is compact and stable; is less bulky than ice buckets and does not rely on ice and water to maintain the chill on a container.

11 Claims, 4 Drawing Sheets

DEVICE FOR MAINTAINING THE CHILL ON A BOTTLE OF WINE

This application is a continuation, of application Ser. No. 06/908,658, filed 09/18/86 now abandoned.

FIELD OF INVENTION

The present invention is directed to a device which can assist in maintaining the chill on a container such as a wine bottle.

BACKGROUND ART

To maintain the chill on a container, such as a wine bottle, the container frequently is placed in a bucket containing an ice and water mixture, before and/or after the container has been opened. There are disadvantages to the use of an ice bucket for chilling and maintaining the chill on a container. The bucket must be filled with ice, the ice and water must be disposed of, and the container comes out of the bucket dripping chilled water. Additionally, the ice bucket is usually much larger than the container; is frequently unstable and, if spilled, a mess results.

A clay bucket kept in a cool environment and/or soaked in chilled water is sometimes used to maintain the chill on a wine bottle. The clay bucket absorbs chilled water while in the cool damp environment. During use, the heat lost through evaporation in combination with the thermal mass of the bucket assist in maintaining the chill on the wine bottle. This method has a disadvantage in that the clay bucket must be kept in a chilled environment; the cooling contribution from the evaporation process varies with temperature and humidity; and the clay bucket may become wet and slippery from the condensation.

Marble buckets are also used. Marble like clay is porous. Because of the grain of certain natural marbles, marble buckets can be attractive. Before use the buckets are placed in a cool, damp environment. Water tends to collect in the interstices of the marble, and because of the high heat capacity of marble, the marble tends to maintain the chill. When it is desired to use the marble bucket to maintain the chill on a bottle of wine, the bucket is removed from the cool damp environment and a bottle of wine is placed in the bucket. Marble buckets have the disadvantage that they fracture easily and are heavy. If the marble bucket is used in a damp, moist environment, the exterior will becomes damp and slippery.

Several patents are directed to devices to assist in, or to establish the chill on a container, such as a bottle of wine. Henry de Toro and Eric Valle U.S. Pat. No. 4,531,381 entitled "COOLER ASSEMBLY" teaches a cooler assembly specifically contoured and designed to cool and maintain a bottled liquid at a lower than ambient temperature. The device of the '381 patent is essentially a sealed ice bucket. The '381 device is provided with insulating material and a cooling compartment. The cooling compartment extends into the interior of the the cooler assembly and is, in turn, provided with a compartment contoured to accommodate a bottle. The recommended coolant is water. The device can be either filled with chilled water, or filled with water at ambient temperature and then placed in a freezer or refrigerator. Although the device of the '381 patent overcomes some of the objections to the prior art ice bucket and the clay and marble buckets, the device of the '381 patent is bulky; relies on a water and/or water and ice; and, if used as suggested in the '381 patent, will require a significant amount of refrigeration space to prepare the cooler for use.

Frederick Lobl U.S. Pat. No. 2,496,296 entitled "PORTABLE REFRIGERATED CONTAINER" teaches a container which can be used to maintain the chill on any of a wide variety of items. The portable refrigerated container, or food cooling box, is comprised of a main box and at least one smaller removable container which can be arranged within the main box at the discretion of the user. The main box is provided with refrigerated walls. The container of the '296 patent is of a design similar to a variety of refrigerated containers such as the picnic containers produced by Igloo TM. Although the containers can keep a wide variety of foods, such as sandwiches and soft drinks, at a temperature less than ambient temperature for an extended period of time. The container of the '296 patent is not well suited for use in maintaining the chill on an open bottle of wine since during serving, the wine bottle is frequently placed into and removed from the container. Further, an open container such as taught in the '296 patent, which does not embrace the bottle, would not effectively impart a chill to the bottle. Therefore, a container such as taught in the '296 patent would be ineffective for imparting a chill to, or for maintaining the chill on a bottle which was intermittently placed in and taken out of the container.

The current invention does not rely on the use of ice and/or chilled water. The current device is well suited for intermittent use. In addition, in a preferred embodiment of the present invention, means are provided to wipe the container as it is removed and to thereby reduce the tendency of a container to drip chilled water. The present invention is of a size and shape that can be readily stored and easily transported. The present invention overcomes a number of the disadvantages of prior art devices.

SUMMARY OF INVENTION

Frequently it is desired to maintain the chill on a container, such as a bottle of wine. The present invention is directed to a device for maintaining the chill on a container, such as a wine bottle.

It is an object of the present invention to provide a vessel for chilling wine and other bottled liquids which does not require ice.

It is an object of the present invention to provide a vessel for chilling wine which is readily transportable.

It is an object of the present invention to provide a vessel whereby a chill can be maintained on a container.

It is another object of the present invention to provide a device to maintain the chill on a bottle of wine, and yet allow the chilled wine to be poured without dripping condensed liquid from the exterior of the bottle.

It is another object of the present invention to provide a vessel which can be used to impart a chill to a container.

It is another object of the present invention to provide a container which can rapidly effect the chilling of a container, such as a wine bottle.

It is an object of the present invention to provide a vessel for maintaining the chill on a bottle of liquid which has less bulk than the conventional ice bucket.

It is another object of the present invention to provide a vessel which can be used to maintain an elevated temperature on a container of liquid when the container is transported in a chilled environment.

It is an object of the present invention to maintain a uniform temperature on a container when the container is moved through environments having variations in temperature.

It is another object of the present invention to provide a vessel which can be used to impart a chill to foods, and in particular to baby foods.

It is yet another object of the present invention to provide a vessel which can be used to maintain the chill on a container, such as a container of baby food.

These and other objects of the present invention will become apparent to one skilled in the art from the following description, figures and examples.

The present invention in its simplest form is a vessel having a sidewall of high heat capacity and having a portion of the exterior an insulating material. When it is desired to use the vessel of the present invention to maintain the chill on a container, or to impart a chill to a container, the vessel is first placed in a chilled environment, such as a freezer or refrigerator, for a time sufficient to impart a chill to the sidewall of the vessel. Because of the high heat capacity of the sidewall, the vessel will maintain the chill.

In a preferred embodiment of the present invention, the top of the vessel is provided with means which allow for the insertion of a container into the vessel while limiting the flow of air from the interior of the vessel.

In another preferred embodiment of the present invention, the upper portion of the vessel is provided with an absorbant closure which engages the container when the container is removed from the vessel. The absorbant closure wipes from the container moisture which may have condensed on the chilled container.

In a preferred embodiment of the present invention the vessel is provided with high thermal conductivity fins which extend to contact the container placed within the vessel. The high heat conductivity fins accelerate heat transfer from the container to the sidewall of the vessel.

In another preferred embodiment of the present invention the vessel is provided with a secure closure means whereby the vessel can be secured in such a manner that chilled air will be trapped in the interior of the vessel so that the chilled air can not communicate directly with the outside environment.

In another preferred embodiment of the present invention, the vessel is provided with constrictors that are attach to the interior wall. The constrictors, in addition to limiting movement of the container within the vessel, provide paths for heat conductivity between the container and the vessel sidewall.

In a preferred embodiment of the present invention, the vessel is constructed with a hollow sidewall which can be filled with a material, such as a polymer or a salt solution, having a high heat of fusion and a melting point near or slightly below the temperature at which it is desired to maintain the container. When the vessel is used to store white wine, the sidewall can be filled with a material having a melting point of between about 0° C. and 5° C. When the vessel of the present invention is used to store red wine a material having a melting point of between about 15° C. and 18° C. should be used to fill the sidewall.

The container in combination with the vessel can be placed in a chilled environment for a time sufficient to impart a chill to both the container and the vessel. The vessel in combination with the container can then be removed from the chilled environment for either transport or intermittent use of the container.

Alternatively, the vessel of the present invention can be placed in a chilled environment for a time sufficient to impart a chill to the sidewall. When it is desired to use the vessel, the vessel is removed from the chilled environment and the container placed within the vessel.

When the vessel of the present invention is no longer needed to maintain a chill on a container, the vessel can be returned to the chilled environment for storage. Returning the partially chilled vessel to a chilled environment can save energy.

BEST MODE OF CARRYING THE INVENTION INTO PRACTICE

Frequently it is desired to maintain the chill on a container, such as a wine bottle, during intermittent use, transport or storage.

The most common method of maintaining the chill on a container is to place the container in a bucket filled with an ice and water mixture. This method has a number of disadvantages. Included among these disadvantages are that ice buckets are bulky; the bucket must be filled with ice or ice and water; the liquid and ice must be disposed of; and the container placed in the bucket comes out of the ice bucket dripping chilled water.

Figure 1:
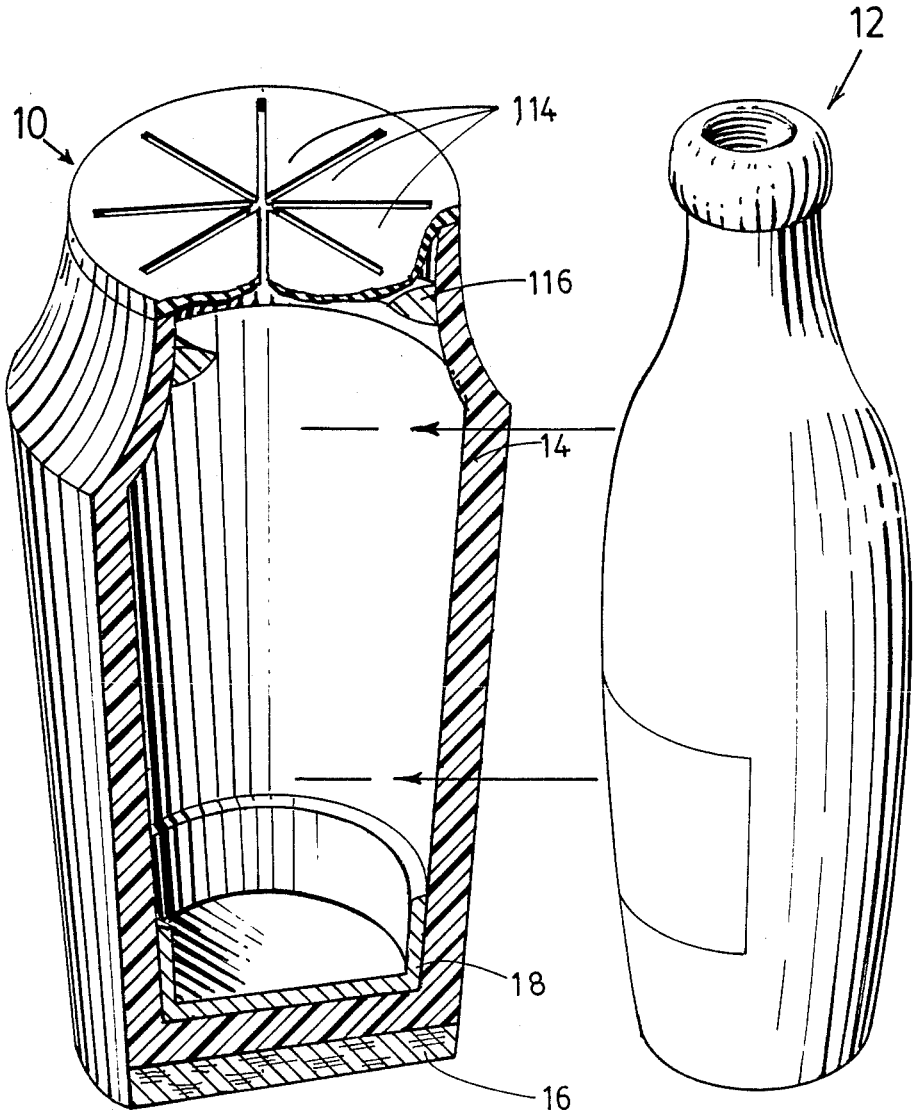
FIG. 1 is a schematic representation of an embodiment of the present invention in which the sidewall of the vessel is made of a high heat capacity material and the vessel is provided with a closure means for limiting the flow of chilled air from the vessel.

FIG. 1 is a schematic representation of a vessel 10 in accordance with the present invention. The vessel 10 can be used to maintain the chill on any of a variety of containers such as a wine bottle 12. The vessel 10 has a sidewall 14 which is made of a high heat capacity material. Forming the sidewall 14 of a high heat capacity material, allows the vessel to maintain a chill. Before use, the vessel 10 is placed in a chilled environment, such as a refrigerator, freezer, or snowbank, for a time sufficient to chill the sidewall 14. After the vessel 10 has been chilled, the bottle 12 can be placed in the vessel 10. Because of the high heat capacity of the sidewall 14 the vessel will assist in keeping the bottle cool.

It is preferred that an insulation material be provided to the bottom 16 of the vessel 10. Using an insulting material, such as cork, for the bottom 16 of the vessel 10 reduces the likelihood that condensation will collect on the bottom of the vessel and that heat will be conducted to any surface upon which the vessel is placed.

In addition, a high conductivity material such as a metal foil 18 can be used on the inside bottom of the vessel to improve thermal communication between the bottle 12 and the vessel 10. The high conductivity metal foil 18 should preferable contact the base and a portion of the sidewall of both the vessel 10 and bottle 12.

Figure 2:
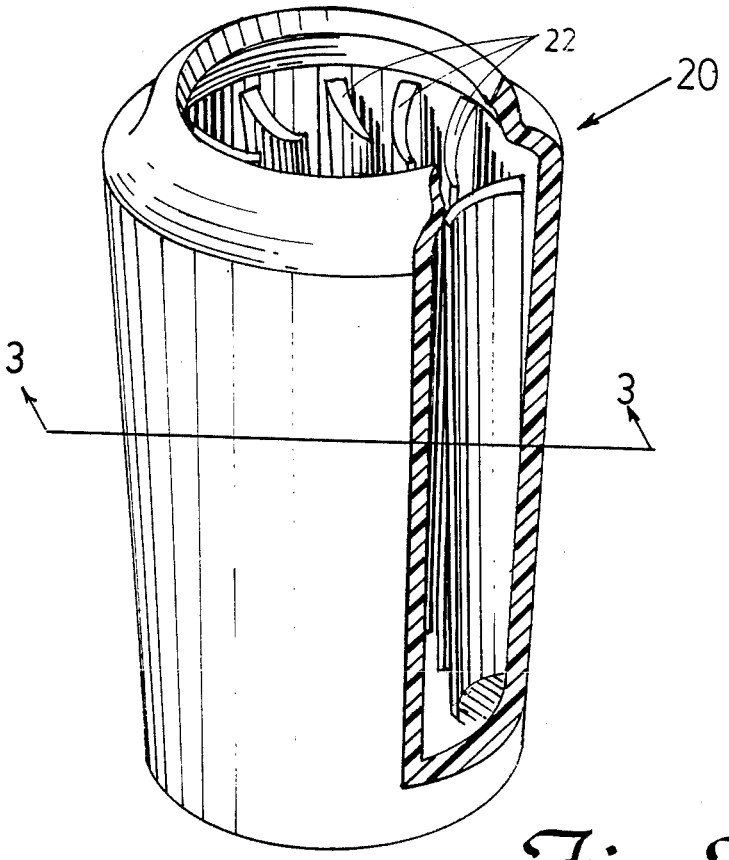
FIG. 2 is a schematic representation of another embodiment of the present invention in which the interior of the vessel is provided with high heat conductivity fins which extend from the sidewall and contact the container placed within the vessel.

In a preferred embodiment of the present invention the interior of the vessel is provided with high thermal conductivity projections which provide for thermal communication between the vessel and the container which may be placed within the vessel. FIG. 2 is a schematic representation of an embodiment in which the interior of the vessel 20 is provided with high thermal conductivity projections in the form of flexible fins 22. The fins 22 flex in such a manner as to adjust to the size of the container placed within the vessel 20. In this manner, containers of varying sizes can be placed within the vessel and each can be maintained in thermal communication with the chilled sidewall of the vessel.

A rubberized material which has been impregnated with copper wires can be used for the flexible fins. Likewise, a rubberized material which has been overlayed with a thin foil can be used.

Figure 3:
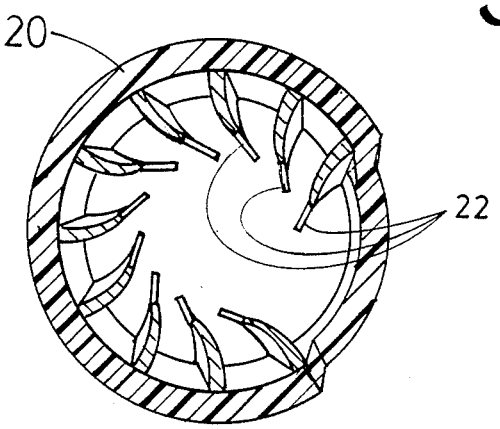
FIG. 3 is a cross section 3—3 of FIG. 2.

FIG. 3 shows a cross section of FIG. 2 and illustrates the spiral character of the flexible fins 22. The spiral arrangement of the fins 22 allows a container to spread the fins.

Figure 4:
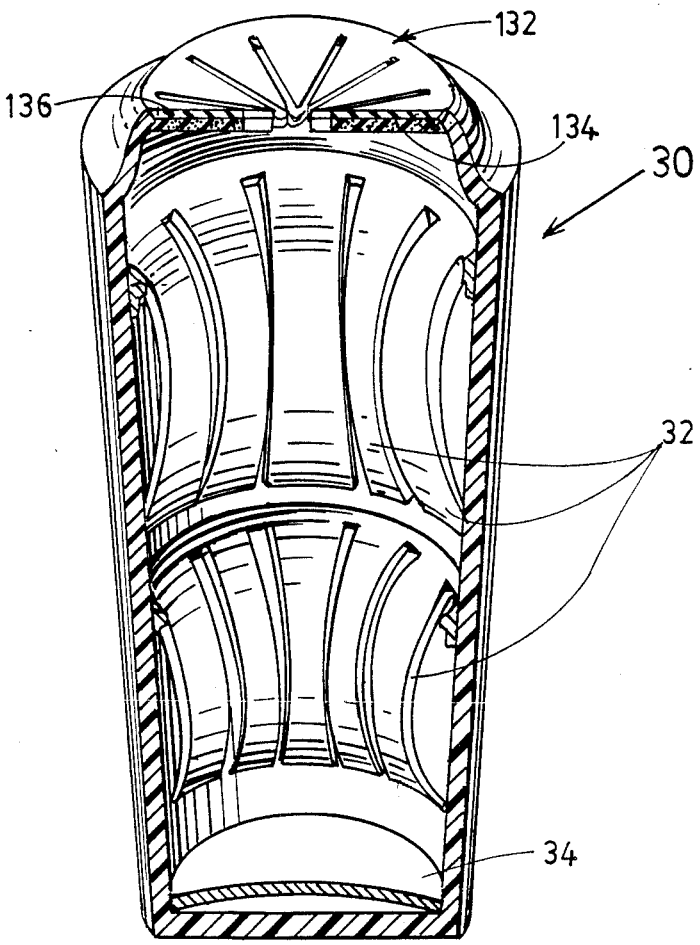
FIG. 4 is a schematic representation of an embodiment of the present invention in which the vessel is provided with high conductivity constrictors and top sealing means.

FIG. 4 shows an alternate design of high conductivity projections. In FIG. 4, the vessel 30 is provided with high heat conductivity constrictors 32. The high conductivity constrictors 32 restrict movement of a container placed within the vessel, while maintaining the vessel and container in thermal communication. The vessel 30 shown in FIG. 4 is well suited for use in the transport of a container. The constrictors 32 can be made of a metal such as copper, which is alloyed so as to be readily deformable. Alternately, a non-corrosive steel, such as a stainless spring steel could be used for the high conductivity constrictors 32.

In a preferred embodiment a high conductivity flexible base element 34 is provided to the inside of the vessel 30. The high conductivity flexible base element 34 will allow for thermal communication between the base of the container and the high heat capacity base sidewall of the vessel.

Preferably the vessel of the present invention is provided with a top closure. FIG. 1 shows a single layer flap closure 112. FIG. 3 shows a double layer flap closure 132. The flat closures 112 and 132 are provided to the vessel to limit the flow of air into and out of the vessel. Limiting the flow of air allows the chill to be maintained for an extended period of time on the container placed within the vessel. The closure should allow a container to be inserted into the vessel and then closes tightly around the neck of the container or over the top of a short container. The top closure 112 is preferably made of a series of pie shaped soft and flexible segments 114.

In a preferred embodiment, the top closure 132 is provided with an absorbent inner lining 134. The absorbant inner lining 134 wipes moisture from the container when the container is removed from the vessel 30. If an inner lining is not provided to the inside surface of the flexible closure an absorbent protrusion 116, such as shown in FIG. 1, can be provided to whip moisture which may condense on a container place within the vessel from the container as the container is removed from the vessel.

Figure 5:
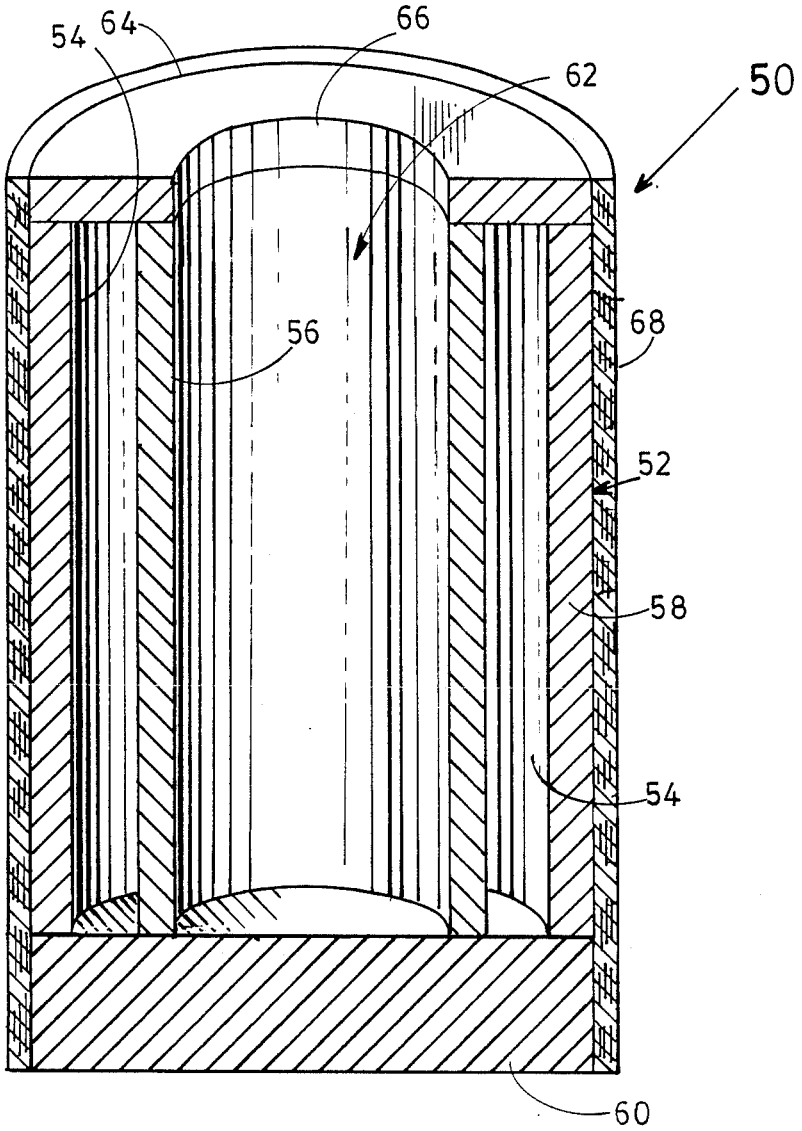
FIG. 5 is a schematic representation of a vessel in a accordance with the present invention which has a sidewall chamber which can be filled with a high heat capacity material.

FIG. 5 show a preferred embodiment of the present invention, in which the vessel 50 is constructed with a sidewall 52 having a sidewall cavity 54. The sidewall cavity 54 is formed by an inner sidewall 56 which is spaced apart from an outer sidewall 58. The inner sidewall 56 and the outer sidewall 58 are attached to a vessel bottom 60. The vessel bottom 60 and the inner sidewall 56 form a central cavity 62. The inner sidewall 56 and the outer sidewall 58 are connected at the top by an element 64. The element 64 closes the sidewall cavity 54. The top element 64 is provided with an opening 66 which allow for access to the central cavity 62.

The sidewall cavity 54 can be filled with a liquid having a melting point close to and preferably slightly below the temperature at which it is desired to maintain the container. For example, if the vessel is to be used to maintain the chill on white wine, the cavity 54 can be filled with a liquid having a melting point of about 0° C. to 7° C. If the vessel is to be used to contain a red wine the sidewall cavity 54 can be filled with a liquid having a melting point of about 15° C. to 22° C. since a serving temperature of 18° C. is appropriate for red wine to optimize the bouquet and aroma of the wine.

Preferably the vessel 50 has an exterior surface 68 which is insulating. An exterior insulating surface 68 can be provided by placing the vessel 50 in a sleeve made from cork or an insulating polymer. By insulating the exterior of the vessel the chilled can be maintained within the vessel for a longer period of time and condensation on the exterior of the vessel is limited.

The vessel of the embodiment shown in FIG. 5 can be provided with closure means and with means for wiping condensed moisture from the container.

The vessel of the present invention in combination with a container can be placed in a chill environment. Alternatively the vessel can be chilled and then the vessel used to impart a chill to a container. The vessel of the present invention can also be used to maintain a warm container at a temperature greater than ambient, or to maintain a uniform temperature on a container which is to be moved through environments of different temperature.

The vessel of the present invention is energy efficient in that after the vessel has been used, if a reduced temperature or chill remains in the vessel, the chill can be saved by placing the vessel in a chilled environment.

While the novel features of this invention have been described in terms of preferred embodiments and particular applications, it will be appreciated that various omissions and substitutions in form and in detail may be made by those skilled in the art without departing from the spirit of the invention.

What I claim is:

1. A vessel for containment of a container comprising:

an inner sidewall forming passage;

an outer sidewall spaced apart from said inner sidewall;

a bottom attached to said inner sidewall and said outer sidewall and closing the passage to form a central cavity;

a top having an opening to allow access to said central cavity, the top being attached to said inner sidewall and said outer sidewall so as to form a sidewall cavity, said sidewall cavity being filled with a fluid having a selected melting point; and a flexible port covering said opening.

2. The vessel of claim 1 wherein the fluid has a melting point of between about 0° C. and 7° C.

3. The vessel of claim 1 wherein the fluid has a melting point of between about 15° C. and 22° C.

4. The vessel of claim 2 wherein the inner sidewall has high conductivity and the outer sidewall is an insulator.

5. The vessel of claim 1 further comprising wiping means, said wiping means being attached to said opening in said top.

6. The vessel of claim 1 further comprising a closure means for said opening with said closure means having wiping means attached thereto.

7. The vessel of claim 3 wherein said inner sidewall has high conductivity and said outer sidewall is an insulator.

8. An open vessel for holding a container, the vessel having a sidewall surrounding a central cavity and an absorbant means for wiping the container:

the sidewall being constructed of a high heat capacity material;

the central cavity being contoured to circumferentially circumscribe and accept the container;

a portion of the exterior of the vessel being of an insulating material and:

the absorbant wiping means being attached to the vessel and so positioned as to wipe the container when the container is removed from the vessel.

9. The vessel of claim 8 wherein high thermal conductivity flexible fins are attached to the sidewall of the vessel and extend into the central cavity.

10. The vessel of claim 8 wherein the vessel is provided with a closure and said means for wiping are attached to said closure.

11. The vessel of claim 10 wherein high thermal conductivity flexible fins are attached to the sidewall of the vessel and extend into the central cavity.

* * * * *